US006701814B2

(12) United States Patent
Purkapile

(10) Patent No.: US 6,701,814 B2
(45) **Date of Patent: *Mar. 9, 2004**

(54) MULTIBLADE SCREWDRIVER

(75) Inventor: Emerson Purkapile, Scottsdale, AZ (US)

(73) Assignee: WMH Tool Group, Inc., Elgin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/113,913

(22) Filed: Apr. 1, 2002

(65) Prior Publication Data

US 2002/0162429 A1 Nov. 7, 2002

Related U.S. Application Data

(63) Continuation of application No. 09/608,156, filed on Jun. 30, 2000, now Pat. No. 6,378,407, which is a continuation-in-part of application No. 09/209,766, filed on Dec. 11, 1998, now abandoned.

(51) Int. Cl.[7] ..... B25G 1/08
(52) U.S. Cl. ..... 81/490; 81/177.4; 81/438
(58) Field of Search ..... 81/177.4, 438, 81/490

(56) References Cited

U.S. PATENT DOCUMENTS

| | | | | |
|---|---|---|---|---|
| 2,409,613 A | * | 10/1946 | Brooks | 81/177.4 |
| 4,241,773 A | * | 12/1980 | Personnat | 81/490 |
| 4,273,173 A | * | 6/1981 | Smith et al. | 81/177.4 |
| 4,463,788 A | * | 8/1984 | Corona et al. | 81/490 |
| 4,552,043 A | * | 11/1985 | Corona et al. | 81/490 |
| 4,552,044 A | * | 11/1985 | Corona et al. | 81/490 |
| 4,716,795 A | * | 1/1988 | Corona et al. | 81/177.4 |
| 4,716,796 A | * | 1/1988 | Corona et al. | 81/177.4 |
| D323,449 S | | 1/1992 | Corona et al. | |
| 5,228,363 A | | 7/1993 | Corona et al. | |
| 6,332,384 B1 | | 12/2001 | Cluthe | |
| 6,378,407 B1 | | 4/2002 | Purkapile | |

* cited by examiner

*Primary Examiner*—James G. Smith
(74) *Attorney, Agent, or Firm*—Fitch, Even, Tabin & Flannery

(57) ABSTRACT

A hand-held screwdriver assembly having interchangeable blades which are held within a hollow handle and are available to be selected and moved through a cross-slot in a cap assembly on the handle to a stop position, and then to be secured in a chuck for use. Rotation of the cap assembly is prevented when the blade is secured in the chuck, thus precluding the introduction of a second blade into the cross-slot.

13 Claims, 4 Drawing Sheets

MULTIBLADE SCREWDRIVER

CROSS REFERENCE TO RELATED APPLICATIONS

This application is a continuation of U.S. application Ser. No. 09/608,156 filed Jun. 30, 2000, now U.S. Pat. No. 6,378,407 which is a continuation-in-part of U.S. application Ser. No. 09/209,766 filed Dec. 11, 1998 now abandoned.

FIELD OF THE INVENTION

The invention relates to hand-held screwdrivers having interchangeable blades which are held within the handle and are available to be selected for various types of screws such as those having a straight slot, Phillips head, etc. Alternatively, the blades can be adapted to receive sockets or other shapes to hold or drive various types of fasteners.

DESCRIPTION OF RELATED ART

There are and have been on the market multiblade screwdrivers which are simply units with a hollow handle in which a number of screw driver blades are stored, and with a removable cap so that the blades can be removed and affixed to one end of the handle in operative position. These have the negative factor of loose blades which can be readily removed and misplaced.

Other forms of multiblade screw drivers are illustrated by U.S. Pat. Nos. 4,463,788; 4,716,796; 4,557,943 and 5,228,363. All of these have multiple, usually six, screwdriver blades or shafts which are mounted in multiple peripheral openings or storage slots disposed lengthwise on the outer portion of the handle. The operator can select the desired blade located in the storage portion of the handle and slide it forward toward an operative position. The blade moves forward through the storage slot to the forward end of the handle until it reaches a point where a stopping mechanism on the base of the blade engages the inside of the cap and prevents the blade from falling out. The blade is then in the outer portion of a cross slot in the cap perpendicular to and above the storage slot. It can be moved in the cross slot toward the center of the handle and when in the center, moved toward the back of the handle into a chuck element, generally having a magnet in its base, which holds the blade in operative position on the central axis of the screwdriver assembly. Shaped portions in the base of the blade engage correspondingly shaped portions of the chuck to prevent rotation of the blade when it is in the chuck. This permits a downward, twisting force to be exerted on the blade/handle combination to engage the fastener and prevent rotation of the blade in the handle to permit screwing or unscrewing of the fastener.

In the prior art devices, the cross slot through which the blade moves from storage to operative position in the chuck is composed of two parts, a slot in the top of the cap which encloses the forward end of the handle and a corresponding slotted portion in a rotatable disk which can rotate within the cap. When moving the blade from storage to operative position, the cross slots are lined up to permit the movement of the selected blade from the storage to the operative position or vice versa. To retain the blade in the chuck and prevent movement of the blade either outward or within the slot, the disk is rotated, perhaps 90 degrees, so that the disk having the slot no longer is lined up with the slot in the cap and thus the blade is held or locked in place in the chuck.

SUMMARY OF THE INVENTION

It is an object of the invention to prevent rotation of the cap assembly when the blade is in the chuck, thus precluding the introduction of a second blade into the cross-slot which can occur in prior art devices because a user's hands gripping the handle and twisting the screwdriver can fairly easily rotate and unlock the exposed lock ring on the disk mounted in the forward end of the handle.

It is a further object of the invention to construct a multiblade screwdriver with the use of fewer and simpler parts while providing the same ability to move from storage to operative position, to retain the blade within the handle and to move to the operative position, locking the blade into the operative position.

Applicant's improved construction provides for a blade of simple polygonal, and preferably hexagonal, cross sectional configuration, eliminating relatively expensive forming or machining steps required to make the blade configuration in the prior art devices. Thus, the blade configuration can be formed from a hexagonal length of steel of like metal having a screwdriver shape or configuration at the outer end. The portion near the inner end has a flat notch cut in opposite sides of the hex, preferably in angled portions. This notch is cut across the hex on two portions of the hex opposite each other to form a flat sided notch which will enable the blade to slide along a track portion of the opening which is formed in the cap. A lug or "wing" is formed on the inside base portion of the blade adjacent one or both of the flat notched portions for the purpose of engaging the inside of the cap adjacent to the hex opening track portions to prevent the blade from being removed from the handle.

DETAILED DESCRIPTION OF THE INVENTION

Figure 1:
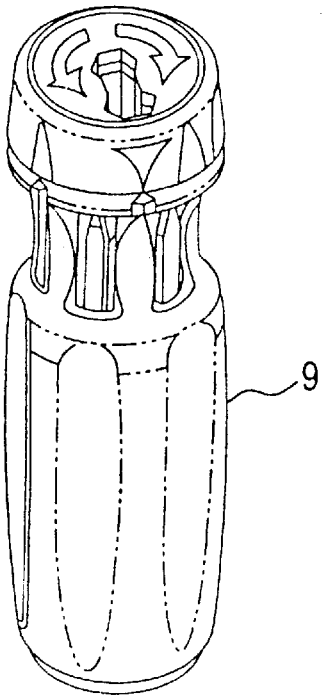
FIG. 1 is a perspective view of a screwdriver assembly according to the invention with the blades retracted into the handle.
Figure 2:
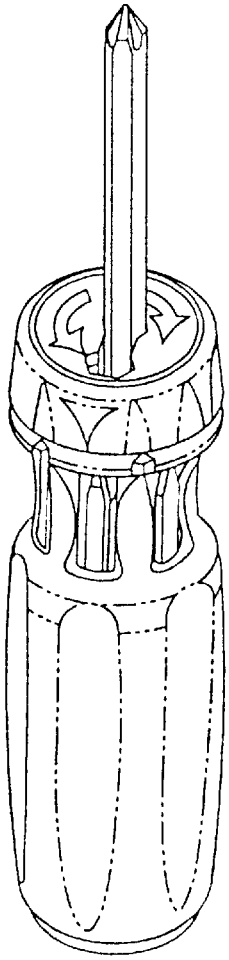
FIG. 2 is a perspective view of the screwdriver assembly of FIG. 1, with a blade extended into operative position.
Figure 3:
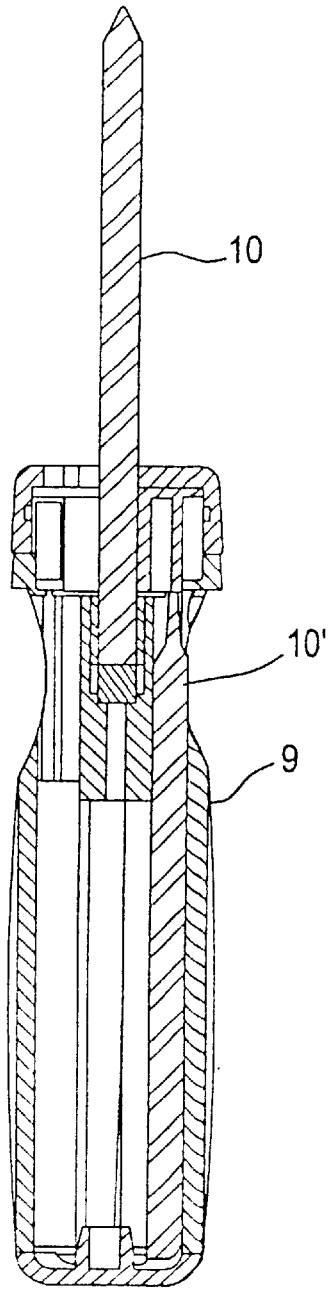
FIG. 3 is a vertical cross-sectional view of the screwdriver assembly of FIG. 2.
Figure 4:
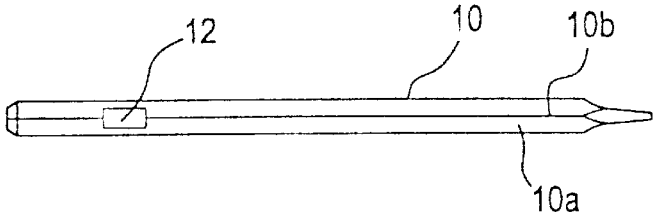
FIG. 4 is a side view of one of the blades of the screwdriver assembly of the invention.
Figure 5:
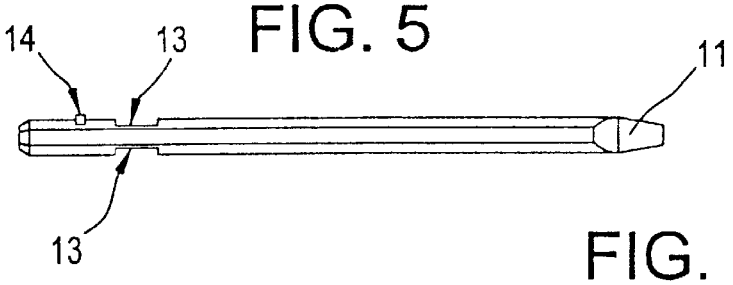
FIG. 5 is a side view of the blade of FIG. 4 rotated 90°.
Figure 8:
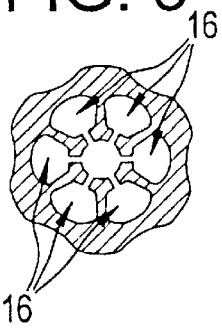
FIG. 8 is a cross-sectional view taken substantially along line B—B of FIG. 6.
Figure 9:
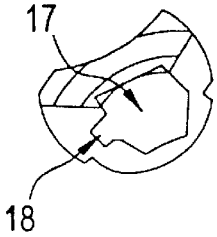
FIG. 9 is an enlarged detail of a blade storage slot according to the invention.
Figure 7:
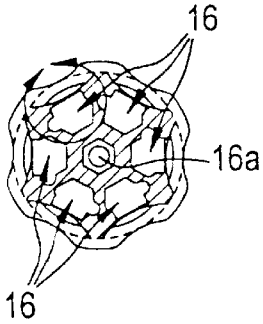
FIG. 7 is a cross-sectional view taken substantially along line A—A of FIG. 6.

The screwdriver assembly of the invention, as shown in FIGS. 1, 2 and 3 has a handle 9 and a plurality of interchangeable blades 10. FIG. 1 shows the handle 9 with all blades retracted and in the storage position, while FIG. 2 shows the screwdriver assembly with a blade 10 in an operative position. FIG. 3 is a cross-section of the screwdriver assembly with one blade 10 in operative position extending through the cap and another slotted blade 10' in a storage position. The blades 10 are formed from hexagonal steel segments shown in FIGS. 4 and 5, having flat surfaces 10*a* connected by angle portions 10*b*, and having a flat screwdriver tip 11 formed at the forward end of the blade. In the preferred embodiment shown in FIGS. 4 and 5, two opposing notches near the back end of the blade are formed by cutting opposing angle portions 12 of the hex to form flat guide surfaces 13 in the hex; a projection-stop means 14 is formed rearward of and adjacent to one of the slots 13. Cutting the notches in the angle portions of the blade enables a reduction in the diameter of the handle. The projection stop-means 14 is adapted to go through the blade slot openings 16 and 17 shown in FIGS. 7, 8 and 9, and to engage the retainer/cap assembly at 28, shown in FIG. 14, to prevent it from being withdrawn from the handle.

Figure 6:
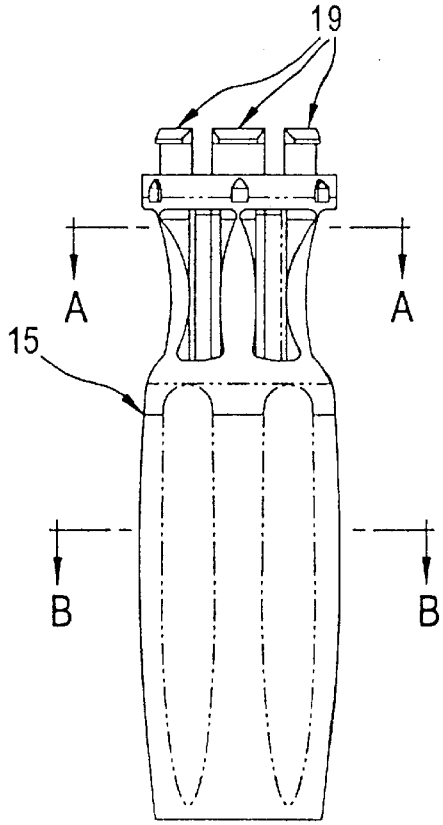
FIG. 6 is an elevational view of a screwdriver handle of the invention with its cap removed.

The handle 15 has a plurality of peripheral storage slots 16 to hold the hexagonal blades disposed around the periphery of the handle parallel to the central axis of the handle which includes a chuck 16*a* for receiving a blade in its operative position. The blade storage slot opening viewed from the upper end has a configuration 17 which holds in sliding engagement the hexagonal blades with a projection receiving slot 18 which receives and guides the projection-stop means 14 in the blade. The handle 15 in FIG. 6 has cap receiving tabs 19 which are adapted to hold a cap on the forward end of the handle.

Figure 10:
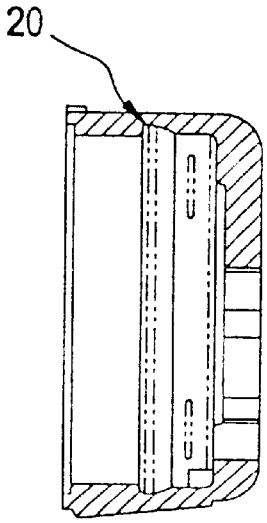
FIG. 10 is an enlarged cross-sectional view of a screwdriver cap according to the invention.
Figure 11:
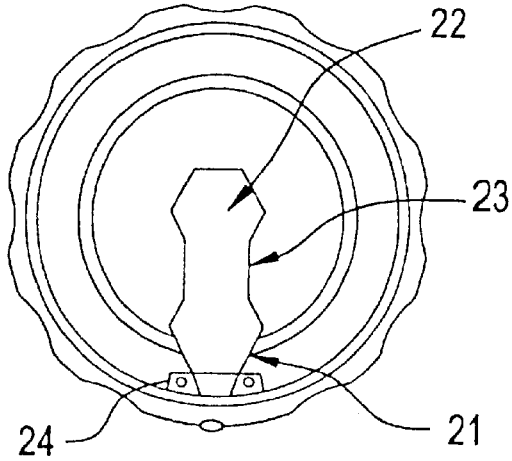
FIG. 11 is a bottom view of the cap of FIG. 10.

FIG. 10 is a cross-section of a cap having an internal groove 20 which rotatably engages tabs 19 to enable the cap to rotate on the forward portion of the handle. FIG. 11 shows the inside of the cap, having a blade guiding opening including hex portion 21 which receives a blade from the storage position or returns it to the storage position. A hex portion 22 disposed in the center above the retainer disc 25 shown in FIG. 13 and an intermediate opening slot 23 which connects the two hex portions 21 and 22. The width of the slot 23 corresponds to the distance between the two faces of flat slot 13 in FIG. 5.

Figure 12:
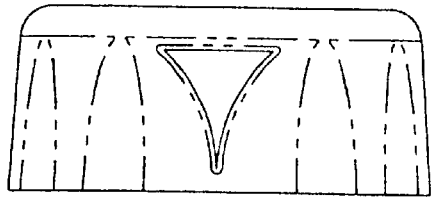
FIG. 12 is an elevational view of the cap of FIG. 10.

FIG. 12 is a side view of the cap showing an arrow which can be lined up with the blades in the storage position in the handle to move or return blades from the storage position to the chuck position.

Figure 13:
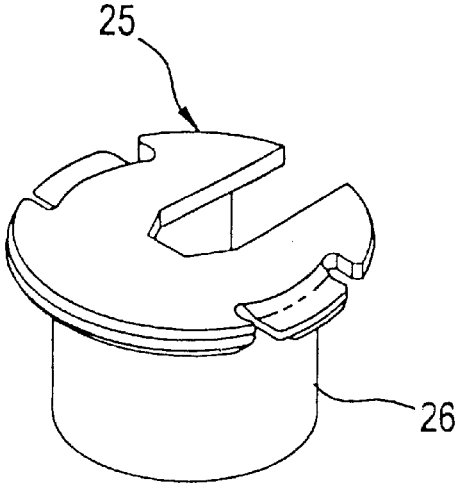
FIG. 13 is a top perspective view of a retainer of the screwdriver assembly of the invention.
Figure 14:
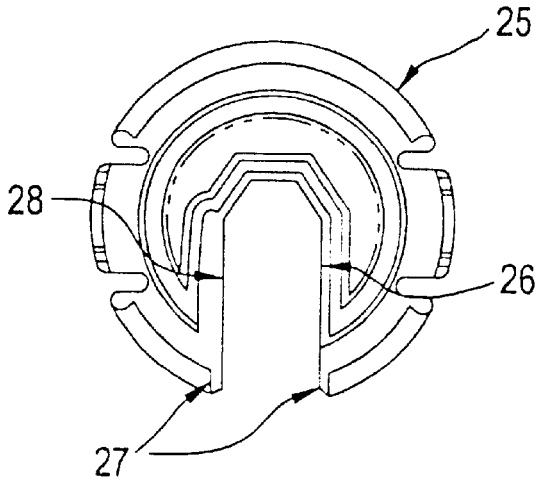
FIG. 14 is a bottom view of the retainer of FIG. 13.

FIGS. 13 and 14 show a retainer which includes a disk portion 25 and a depending blade guide portion 26 of which outside portions 27 engage stop projections 24 in the cap, as shown in FIG. 11, to prevent the disk portion which fits in the cap from rotating relative to the cap.

The blade guide portion 26 of the retainer guides the base of the blade being introduced to the chuck. When the blade is in an operative position in the chuck 16*a*, the retainer/cap assembly is prevented from rotating because the hex blade portion which is in the hex shaped chuck can not rotate with respect to the handle and because the hex opening of the cap and the retainer are also hex shaped, thus preventing everything from rotating until the blade is withdrawn from the chuck when it is being returned to the storage position via hex portions 21 and 22, and slot 23, from a blade position in hex portion 22 to the storage position which would be lined up with hex portion 21.

Figure 15:
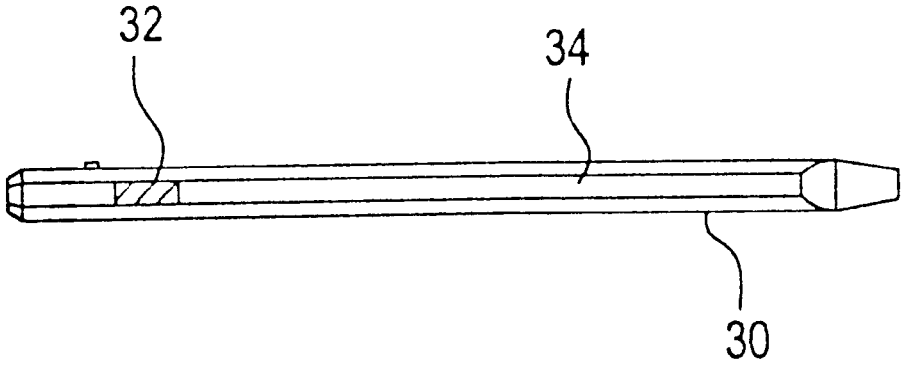
FIG. 15 is a top view of an alternate embodiment of a blade of the invention.
Figure 16:
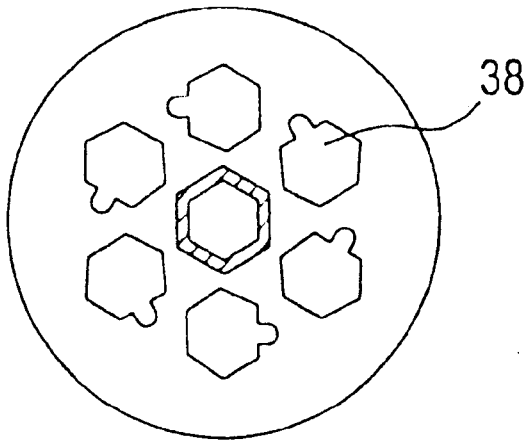
FIG. 16 is a cross-sectional view taken substantially along line A—A of the handle of FIG. 6, in an alternate embodiment used with the blade of FIG. 15.

In the embodiment shown in FIGS. 15 and 16, a blade 30 is formed with notches 32 cut in flat portions 34. While the operation of this screwdriver assembly is essentially the same as the operation of the previously described embodiment, a larger diameter handle is required for the same complement of blades, as can be seen in the arrangement of slots 38 in FIG. 16.

What is claimed is:

1. A bit selector for a tool having a plurality of bits with at least a polygonally shaped portion, the selector comprising:

a center wall having a general central region;

an annular wall extending from generally the perimeter of the center wall, the annular wall having an outer surface for an operator to engage to selectively position the selector; and the center wall defining a first opening and a second opening through which at least a portion of a bit is capable of passing, the first opening being located generally in the central region, and the second opening being located generally adjacent the first opening, at least the first opening having a polygonal shape corresponding to a complimentary polygonal portion of the bit so that the selector may not be moved when the complimentary polygonal portion of the bit is disposed in the first opening.

2. A bit selector according to claim 1 wherein the central wall defines a passage interconnecting the first and second openings, the passage allowing a bit to be intentionally moved between the openings in association with the selector, the passage having a different shape than at least the first opening so as to prevent a bit from being moved unintentionally from one opening to the other.

3. A bit selector according to claim 1 wherein the second opening has a polygonal shape corresponding to a complimentary polygonal portion of the bit.

4. A bit selector according to claim 1 further comprising indicia on at least one of the outer surface of the annular wall and the center wall for providing an operator with at least one of an operational instruction and a selected bit identifier.

5. A bit selector according to claim 4 wherein the indicia includes first indicia on a portion of the center wall, and second indicia on a portion of the annular wall.

6. A multibit tool comprising:

a plurality of bits, each bit having a first and an opposite second end, the second end being configured to perform work on a workpiece;

a handle having an outer gripping surface and defining a plurality of sleeves configured to store a bit in an inoperable position;

a chuck associated with the handle so as to be operated by the handle, the first end of each bit is desired to be received in the chuck when one of such bits is in an operable position; and each bit being movable between a first position located within one of the sleeves of the handle wherein the bit is in the inoperable position and a second position with the first end of the bit nested in the chuck such that the bit is in the operable position; and a bit selector having a general central region, and a generally peripheral region about the central region and defining a first opening at the generally peripheral region for selecting and allowing one of the plurality of bits to be removed from one of the sleeves in the handle and a second opening located generally in the central region of the selector, and the second opening having a polygonal shape corresponding to a complimentary polygonal portion of the removed bit so that the selector may not be actuated when the complimentary polygonal portion of the bit extends through the second opening.

7. A multibit tool according to claim 6 wherein the selector further defines a passage interconnecting the first and second openings, the passage allowing the removed bit to be intentionally moved between the openings associated with the selector, the passage having a different shape than at least the second opening so as to prevent the removed bit from being moved unintentionally from one guide opening to the other.

8. A multibit tool according to claim 7 wherein the first end of the plurality of bits includes a stop extending outward to prevent the bits from being fully removed from either of the first and second openings.

9. A multibit tool according to claim 8 wherein each bit includes at least one narrowed portion capable of fitting in the passage so that the bits may be moved from one opening to the other.

10. A multibit tool according to claim 9 wherein the selector is rotatable between a bit selecting position wherein the first opening is aligned with one of the plurality of bits stored in one of the sleeves of the handle so that the bit may be removed from the sleeve in the handle and a lock position wherein the first opening is not aligned with any one of the plurality of bits stored in the sleeves of the handle so that the bits cannot be removed from the handle.

11. A multibit tool according to claim 10 wherein the polygonal shapes of the bits and second opening are hexagonal shapes which compliment one another and prevent the selector from being rotated while one of the bits is in an operational position in order to prevent additional bits from being removed from the sleeves in the handle while the bit is in the operational position.

12. A multibit tool according to claim 6 further comprising indicia on the selector for providing an operator with at least one of an operational instruction and a selected bit identifier.

13. A multibit tool according to claim 12 wherein at least one of the operational instruction and the selected bit identifier comprises an arrow.

* * * * *